US006349645B1

(12) United States Patent
Roskosch

(10) Patent No.: US 6,349,645 B1
(45) Date of Patent: Feb. 26, 2002

(54) INK FOUNTAIN IN A PRINTING MACHINE AND METHOD OF FIXING AN INK FOUNTAIN FOIL IN AN INK FOUNTAIN

(75) Inventor: Bernhard Roskosch, Wiesloch (DE)

(73) Assignee: Heidelberger Druckmaschinen, Heidelberg (DE)

( * ) Notice: Subject to any disclaimer, the term of this patent is extended or adjusted under 35 U.S.C. 154(b) by 0 days.

(21) Appl. No.: 09/348,159

(22) Filed: Jul. 6, 1999

(30) Foreign Application Priority Data

Jul. 6, 1998 (DE) ..... 198 30 079

(51) Int. Cl.[7] ..... B41F 31/02; B41F 31/00
(52) U.S. Cl. ..... 101/364; 101/367; 101/350.1
(58) Field of Search ..... 101/350.1, 351.1–351.4, 101/352.01–352.05, 364–367

(56) References Cited

U.S. PATENT DOCUMENTS 2,382,103 A * 8/1945 Sandman ..... 101/365
3,094,924 A * 6/1963 Starj ..... 101/210
3,318,239 A * 5/1967 Wintzer ..... 101/364
3,766,853 A * 10/1973 Gallagher et al. ..... 101/113
3,788,220 A * 1/1974 Laben et al. ..... 101/363
4,092,922 A * 6/1978 Schweitzer ..... 101/363
5,042,381 A * 8/1991 Thompson et al. ..... 101/364
5,167,188 A * 12/1992 Lindblom ..... 101/364
5,327,830 A * 7/1994 Gelinas et al. ..... 101/363
5,408,929 A * 4/1995 Rodi ..... 101/365
5,481,974 A * 1/1996 Sarazen et al. ..... 101/363

* cited by examiner

*Primary Examiner*—Kimberly L. Asher
(74) *Attorney, Agent, or Firm*—Herbert L. Lerner; Laurence A. Greenberg; Werner H. Stemer

(57) ABSTRACT

An ink fountain in a printing machine with an ink fountain foil lying on a base of the ink fountain includes an ink metering device having a plurality of metering elements covered by the ink fountain foil, and a device for firmly holding directly on the base of the ink fountain, an underside of the ink fountain foil lying on the base of the ink fountain, and a method for securely fixing the ink fountain foil in the ink fountain.

12 Claims, 4 Drawing Sheets

INK FOUNTAIN IN A PRINTING MACHINE AND METHOD OF FIXING AN INK FOUNTAIN FOIL IN AN INK FOUNTAIN

BACKGROUND OF THE INVENTION

FIELD OF THE INVENTION

The invention relates to an ink fountain in a printing machine with an ink fountain foil lying on a base of the ink fountain, and to a method for securely fixing an ink fountain foil lying on a base of an ink fountain in a printing machine and lining the ink fountain on the inside thereof.

An ink fountain foil or liner inserted into an ink fountain protects sensitive components of the ink fountain, such as ink metering devices, particularly, from direct contact with printing ink present in the ink fountain. When an ink change takes place, the outlay for cleaning the ink fountain is lower, in comparison with ink fountains having no foil or liner.

For example, the published German Patent Document DE 29 28 125 A1 describes an ink fountain for offset or letterpress printing machines, in which an elastic foil is fastenable to an upper edge of the ink fountain in various ways. For fastening the foil to the upper edge of the ink fountain, a tension spindle may be provided that is formed with a longitudinal slot in which the foil is hung. In an alternative construction, the foil may be suspended on a batten or ledge in an upper region of the ink fountain. The foil is not held at the bottom on the base of the ink fountain, but rather, lies loosely and easily displaceable on the ink fountain base.

Although the described ink fountain allows the foil to have a longer service life, the foil, nevertheless, is only inadequately safeguarded against being inadvertently displaced on the ink fountain base.

In an ink fountain with an elastic ink fountain foil that is supposed to fit snugly in recesses of the ink metering elements in the region of an ink gap between the ink metering elements and the ink fountain roller, considerable problems regarding the reproducibility of the ink metering setting arise when the foil lies loosely and easily displaceable on the ink fountain base.

A secure hold of the foil in the ink fountain is desirable, however, even where inelastic ink fountain foils are concerned, which do not have to fit snugly against ink metering elements and serve for protecting specific ink fountain parts from being soiled by the penetration of printing ink into the region of the ink fountain parts.

The published German Patent Document DE 91 07 635 U1 describes an ink fountain, having a single metering element in the form of a tongued inking knife. A cover foil arranged below the tongued inking knife and, therefore, not lining the ink fountain, is adhesively secured to an inking knife bar of the ink fountain.

The published German Patent Document DE 41 25 253 A1 describes an ink fountain with an inking knife and with a metal cover sheet formed as a foil. An upper end of the cover sheet can be secured adhesively to an inking knife bar below the inking knife. This cover sheet also does not line the ink fountain.

The published German Patent Document DE 81 00 093 U1 describes an ink metering device with a slotted inking knife. A covering extending over the entire surface of the inking knife can be covered with a flexible steel foil that is, for example, adhesively secured thereon. The inking knife, the covering and the steel foil form a nonreleasable unit. It is therefore not possible for the steel foil to be removed in any simple manner for the purpose of exchanging it.

SUMMARY OF THE INVENTION

It is accordingly an object of the invention to provide an ink fountain having an ink fountain foil lying securely on a base of the ink fountain and a method for securely fixing the ink fountain foil.

With the foregoing and other objects in view, there is provided, in accordance with one aspect of the invention, an ink fountain in a printing machine with an ink fountain foil lying on a base of the ink fountain, comprising an ink metering device having a plurality of metering elements covered by the ink fountain foil, and a device for firmly holding directly on the base of the ink fountain, an underside of the ink fountain foil lying on the base of the ink fountain.

In accordance with another feature of the invention, the holding device is an adhesive bond by which the ink fountain foil is fastened to the ink fountain base.

In accordance with a further feature of the invention, the adhesive bond is a holding foil having adhesive on both sides thereof, the holding foil being disposed between the ink fountain foil and the ink fountain base.

In accordance with an added feature of the invention, the holding device is a suction device for firmly holding the ink fountain foil on the ink fountain base.

In accordance with an additional feature of the invention, the suction device has at least one suction orifice disposed in the ink fountain base, said suction orifice being able to be supplied with suction air from a suction-air source.

In accordance with yet another feature of the invention, the ink fountain includes an ink fountain roller assigned thereto for conveying printing ink out of the ink fountain through an ink gap, the at least one suction orifice being disposed in a region of the ink fountain base near the ink gap.

In accordance with yet a further feature of the invention, the at least one suction orifice is formed as a groovelike transverse channel extending over substantially the entire width of the ink fountain base and the ink metering device, respectively.

In accordance with yet an added feature of the invention, the ink fountain includes a plurality of the transverse channels arranged substantially parallel to one another in the ink fountain base.

In accordance with yet an additional feature of the invention, the metering elements of the ink metering device are adjustable for zonal ink metering, the ink metering device also includes pressure elements for pressing the metering elements against the ink fountain roller, and the ink fountain base is formed at least partially by a suction plate covering the pressure elements and formed with the suction orifice.

In accordance with another aspect of the invention, there is provided a printing machine having, in combination therewith, at least one ink fountain having at least one of the foregoing features.

In accordance with a concomitant aspect of the invention, there is provided a method for securely fixing an ink fountain foil lying on a base of an ink fountain in a printing machine and lining the ink fountain on the inside thereof, which comprises firmly holding an underside of the ink fountain foil lying on the ink fountain base directly on the ink fountain base by action of force selected from the group thereof consisting of suction force, adhesive force and magnetic force, so that when an ink fountain foil is being exchanged, it can be removed in a relatively simple manner from the ink fountain.

Thus, the ink fountain with an ink fountain foil lying on a base of the ink fountain in a printing machine is distinguished by an ink metering device having a plurality of rotatable and cylindrical metering elements, for example, covered by the ink fountain foil, and by a holding device for firmly holding or securing on the base of the ink fountain, an underside of the ink fountain foil lying on the ink fountain base.

Tests have shown that, in the device of the prior art exemplified by the published German Patent Document DE 29 28 125 A1, the ink fountain foil lies with considerable unevenness in the ink fountain, particularly when a large amount of printing ink is conveyed out of the ink fountain. Elastic ink fountain foils which become elongated present particular problems, especially pronounced displacements out of the original position occurring due to stretching of the ink fountain foil, so that the latter is partly pushed together and partly hollow or concave.

It has been shown that a very good flat or planar position of the ink fountain foil on the ink fountain base or bottom under all operating conditions can be achieved if, instead of or in addition to providing for the holding device to hold the foil edge, for example, the batten or ledge for suspending the foil on the upper edge of the ink fountain, the holding device according to the invention is provided below the ink fountain foil for acting directly on the underside of the ink fountain foil lying on the ink fountain base and, thereby, safeguards the ink fountain foil against slipping out of position.

A preferred embodiment further developing the ink fountain according to the invention calls for the holding device to be an adhesive bond, by which the ink fountain foil is firmly secured to the base of the ink fountain.

For this purpose, the ink fountain foil may be provided with an adhesive layer at the underside thereof, so that the ink fountain foil is self-adhesive in the same way as a self-adhesive foil. The ink fountain foil may also be secured adhesively to the ink fountain bottom by a liquid adhesive layer, for example, a paste or adhesive suitable for plastic, which is applied to the underside of the foil and/or to the ink fountain base. The paste may be a so-called seconds-long adhesive and may very quickly ensure the provision of the necessary bonding force of the ink fountain foil on the ink fountain base. The paste may provide a greater bonding force to the underside of the foil than to the ink fountain base, so that when the foil is removed from the ink fountain, the paste layer is not detached from the foil, but is easily detached from the ink fountain.

Another embodiment is proposed wherein a holding foil having suitable adhesive on both sides thereof is inserted between the ink fountain foil and the ink fountain base. For example, the ink fountain foil may be secured or fastened to the ink fountain base by a plurality of adhesive strips which are adhesively active on both sides thereof. When the ink fountain foil is changed, such adhesive strips can be removed completely in a very simple and rapid manner.

In another embodiment, the holding device is a suction device that holds the ink fountain foil on the ink fountain base.

The ink fountain foil can be sucked tight after it has been inserted into the ink fountain. For example, the suction device may be formed as suction cups or rubber suckers integrated into the ink fountain base. In this embodiment, the ink fountain foil is held firmly on the ink fountain base by vacuum acting upon the underside. In this case, there is no need for a suction-air source for applying suction to the ink fountain foil.

Another embodiment calls for at least one suction orifice of the suction device to be formed in the ink fountain base and connected to a suction-air source. When the ink fountain is in operation, suction air is present at the suction orifice, so that, for example, during printing, the ink fountain foil is sucked onto the ink fountain base. During operational interruptions and, for example, when the rotation of an ink fountain roller of the ink fountain is stopped, the suction-air action may be switched off.

In another embodiment, the ink fountain has an ink fountain roller assigned thereto for conveying the printing ink out of the ink fountain through an ink gap, the suction orifice being disposed near the ink gap.

The metering and ink gap, respectively, may be formed by the ink fountain roller and the metering elements of an ink metering device. By disposing the suction orifice very near to the metering elements, it is possible to avoid undesirable deformation of the ink fountain foil in the region immediately in front of the ink gap, this region being particularly important for metering.

In another embodiment, the suction orifice is formed as a gutterlike or groovelike transverse channel which per se extends substantially in a transverse direction over the entire width of the ink fountain base and of the ink metering device, respectively.

The transverse channel may be formed as a shallow or flat groove running substantially axially parallel to the ink fountain roller. Through the intermediary of a suction orifice formed as a transverse channel, the ink fountain foil can be held, over the entire width thereof, particularly uniformly on the ink fountain base. Instead of or in addition to the transverse channel, a row of suction nozzles may be arranged next to one another in the transverse direction in the ink fountain base.

A plurality of the respective suction orifices described hereinbefore may also be provided. For example, a plurality of transverse channels may be arranged in a forward half of the ink fountain base with respect to the direction towards the ink fountain roller.

In another embodiment, a plurality of transverse channels are arranged to run exactly or virtually parallel to one another.

The transverse channels may be connected to the same suction-air source and, for example, by at least one likewise groovelike longitudinal channel.

In another embodiment, the ink fountain has an ink metering device assigned thereto that includes adjustable metering elements for zonal ink metering, and pressure elements for pressing the metering elements against the ink fountain roller, the ink fountain base being formed at least partially by a suction plate covering the pressure elements and provided with the suction orifice.

If the suction plate is dispensed with, a plurality of pressure elements, for example, every single or every second pressure element, may have a suction orifice or a plurality of suction orifices. The suction orifices formed in the pressure elements may be supplied with suction air from a suction-air source, for example, via flexible hoses.

The method for securely fixing an ink fountain foil lining an ink fountain on the inside thereof and lying on an ink fountain base of the ink fountain in a printing machine calls for firmly holding the underside of the foil lying on the base of the fountain, directly on the base of the ink fountain by the action of suction force, adhesive force or magnetic force, so that the ink fountain foil, when being exchanged, can be removed from the ink fountain in a simple manner.

The ink fountain and method according to the invention can be used in vibrator-type or film-type inking units of rotary printing machines for printing weblike or sheetlike stock or print carriers and which may be constructed as a letterpress, direct lithography or offset printing machine.

Other features which are considered as characteristic for the invention are set forth in the appended claims.

Although the invention is illustrated and described herein as embodied in an ink fountain in a printing machine and a method of fixing an ink fountain foil in an ink fountain, it is nevertheless not intended to he limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
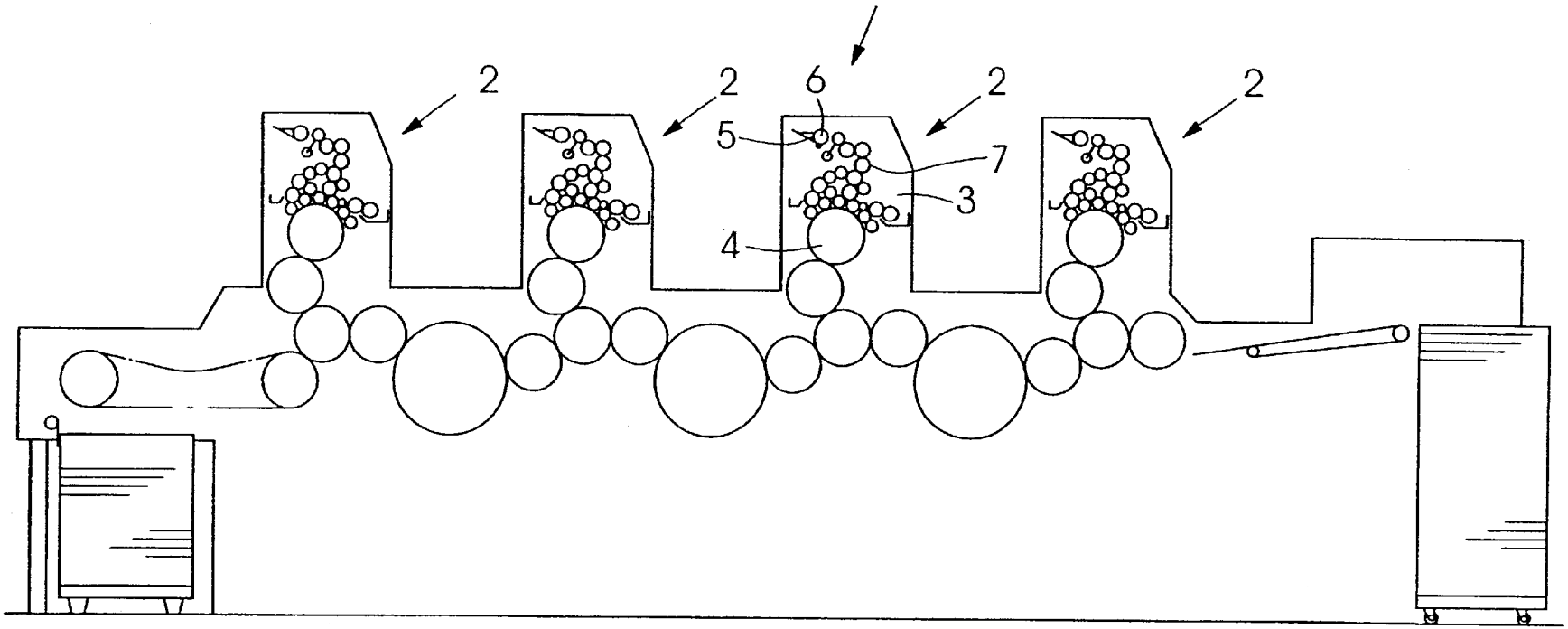
FIG. 1 is a diagrammatic side elevational view of a printing machine equipped with a plurality of ink fountains according to the invention.

Referring now to the drawings and, first, particularly to FIG. 1 thereof, there is illustrated therein a printing machine 1 with a plurality of printing units 2, namely four printing units in this embodiment, each printing unit 2 having an inking unit 3 for applying printing ink to a printing form located on a printing form cylinder 4. The inking unit 3 has a plurality of inking unit rollers 6 and 7, the inking unit roller 6 being formed as an ink fountain roller 6 belonging to the ink fountain 5. The inking unit 3 may be formed as a vibrator-type inking unit having a vibrator roller accepting printing ink stored in the ink fountain 5 from the ink fountain roller 6 and conveying it farther into the inking unit 3. The printing machine 1 is formed as a multicolor offset rotary printing machine.

Figure 2:
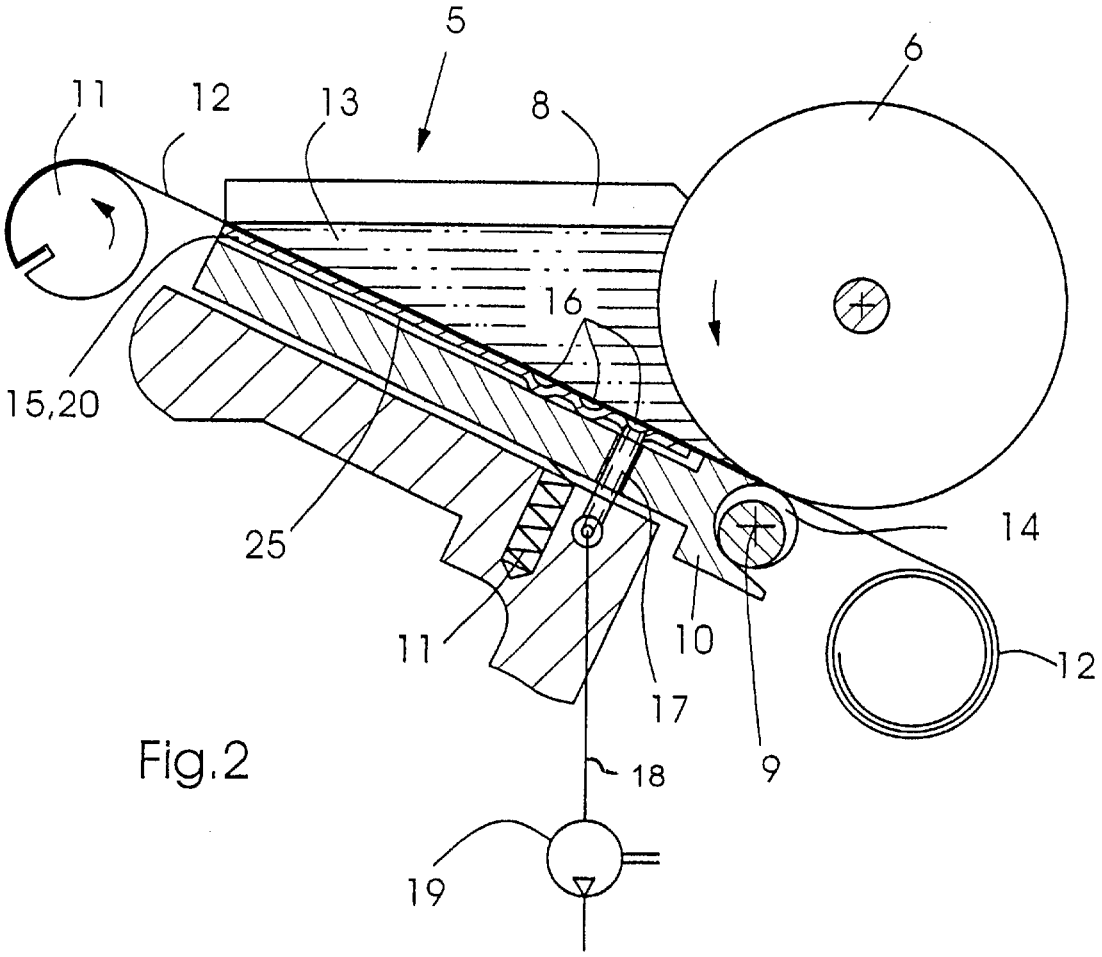
FIG. 2 is a much-enlarged fragmentary view of FIG. 1 showing in section one of the ink fountains of the printing machine.

FIG. 2 illustrates the ink fountain 5 in greater detail. A base 20 of the ink fountain 5, the ink fountain roller 6 and, on each of the two sides of the ink fountain 5, a respective jaw 8 laterally closing off the ink fountain 5 define a wedgelike space, into which printing ink 13 is introduced. The printing ink 13 passes, as a thin ink film disposed on the ink fountain roller 6, out of the ink fountain 5 through ink gaps 14 capable of being differently adjusted or set zonally. An ink metering device 9 to 11 is formed of cylindrical metering elements 9, which are rotatable for adjusting or setting a respective selected quantity of ink, are pressed by a compression spring 11, respectively, via a batten-like or strip-like pressure element 10, against the ink fountain roller 6 or against an ink fountain foil or liner 12 located between the ink fountain roller 6 and the metering elements 9. The ink fountain foil 12 is elastic and, in the region of the ink gap 14, fits snugly in the recess of the metering elements 9 which is delimited by lateral supporting webs and has a sickle-shaped cross section. The ink fountain foil 12 covers both the metering elements 9 and the pressure elements 10, so that the printing ink 13 cannot enter the gaps between the metering elements 9 and the gaps between the pressure elements 10, from which gaps the printing ink 13 is difficult to remove. Moreover, The ink fountain foil 12 lining the inside of the ink fountain 5 permits an uncomplicated change of ink without any major cleaning work. The ink fountain base 20 is formed regionally by a suction plate 15 arranged above the pressure elements 10 and regionally by the pressure elements 10 themselves. The ink fountain foil 12 lies both on the suction plate 15 and on a very short portion of the pressure elements 10. The pressure elements 10, respectively, are formed with a recess into which the suction plate 15 penetrates, so that the pressure elements 10 and the suction plate 15 merge flush into one another and form a planar supporting surface for the ink fountain foil 12. The suction plate 15 is formed of a metal sheet into which beads forming suction orifices 16 are impressed. A vacuum capable of being generated by a suction-air source 19, such as a suction-air fan, for example, can be applied to the suction orifices 16 via a suction-air connection 18 and a suction-air duct 17.

Figure 3:
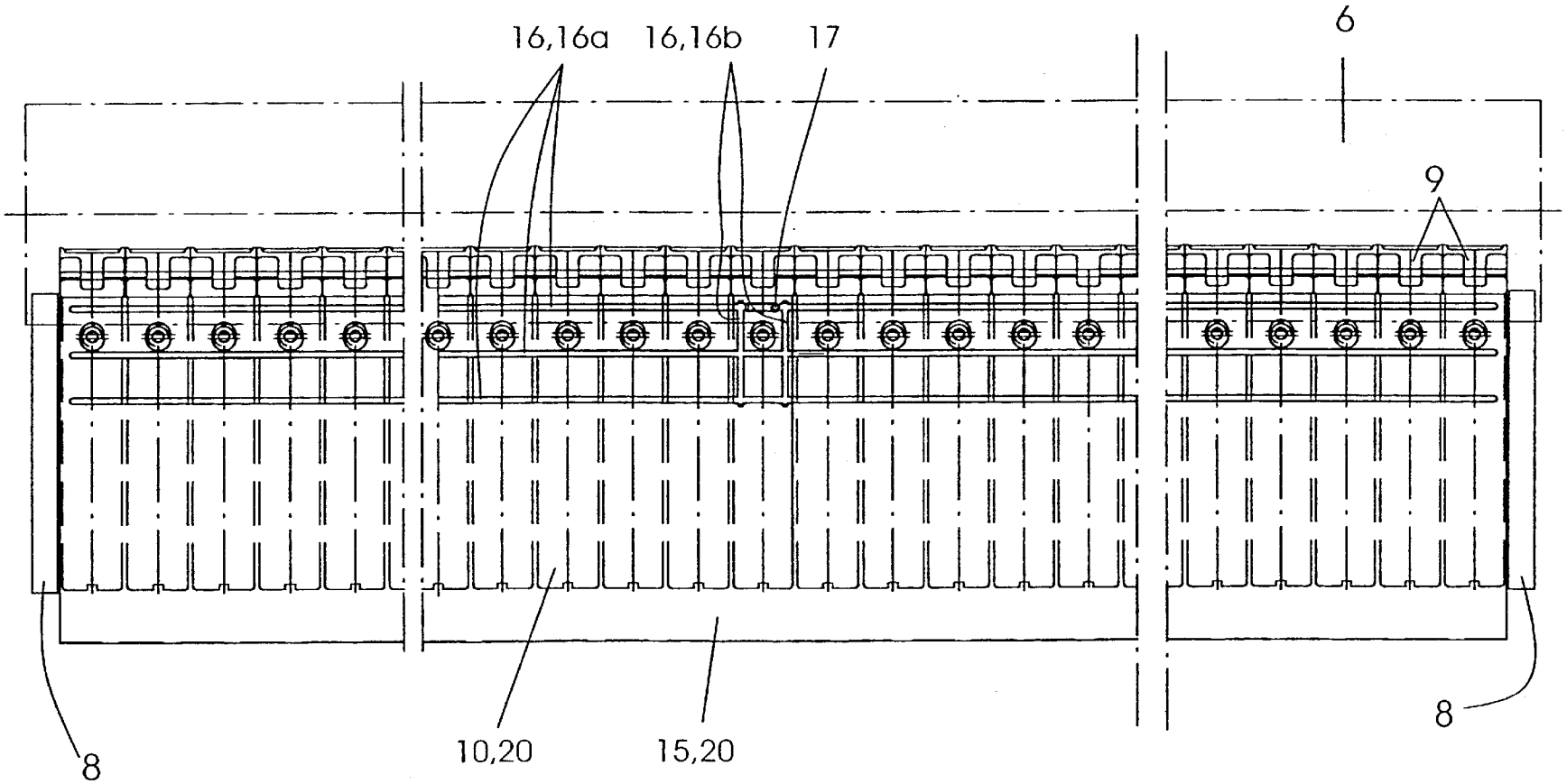
FIG. 3 is a top plan view of FIG. 2 showing the ink fountain, with the printing ink and ink fountain foil thereof removed.

FIG. 3 is a top plan view of the ink fountain 5 without the ink fountain foil 12 and the printing ink 13 actually located therein. This figure shows a suction-groove system open to the viewer and formed of transverse channels 16*a* and groovelike longitudinal channels 16*b* connecting the latter in an air-conducting manner and likewise beaded into the metal sheet. The suction orifices 16 are formed in that third of the ink fountain base 20 which is foremost in the direction of the ink fountain roller 6, a transverse channel 16*a* being arranged directly in front of the metering elements 9 in the ink fountain base 20.

Figure 4:
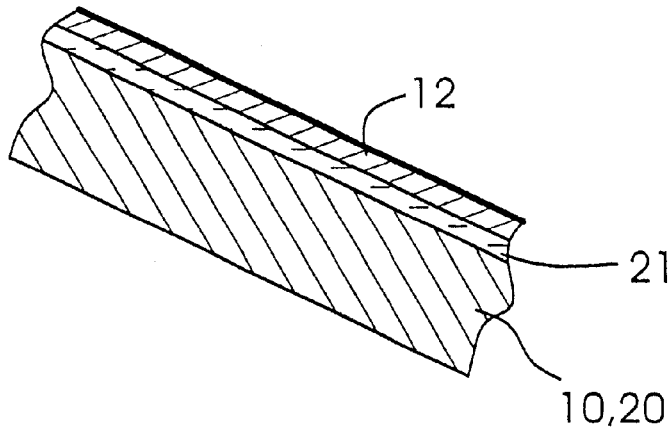
FIGS. 4 to 6 are enlarged fragmentary views of FIG. 2 showing how the ink fountain foil is secured to the base of the ink fountain, respectively, by adhesive bonding, by a suction device in the form of a suction cup, and by magnetic force.

FIG. 4 illustrates a type of fastening that differs from the holding device shown in FIGS. 2 and 3. In the embodiment of FIG. 4, the elastic ink fountain foil 12 is fastened to the ink fountain base 20 by a holding or retaining foil 21 having an adhesive layer on both sides thereof. The holding foil 21 forms a fastening device which holds the ink fountain foil 12 just as securely as the suction devices shown in the afore-described FIGS. 2 and 3, and in the hereinafterdescribed FIG. 5.

Figure 5:
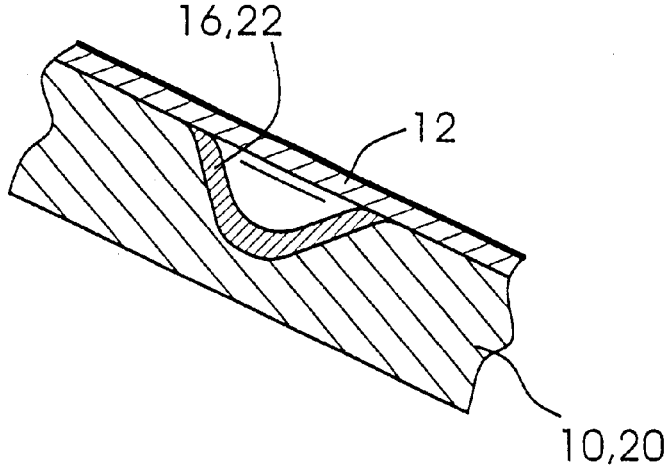

FIG. 5 illustrates another holding device formed as a suction device 16. In contrast with the suction device illustrated in FIGS. 2 and 3, in the suction device 16 of FIG. 5, there is no need for a suction-air source. At least one suction cup 22 is embedded in the ink fountain base 20; the ink fountain foil 12, after being inserted into the ink fountain 5, is pressed against the suction cup 22 with the result that air is displaced from the suction cup 22 and a vacuum sufficient for holding the ink fountain foil 12 is generated. Comparable automatic rubber suckers are known from the field of household articles and serve, for example, for fastening thermometers to window panes. The use of this suction cup 22 is particularly beneficial when the ink fountain foil 12 is comparatively rigid and, for example, is a thin metal foil.

Figure 6:
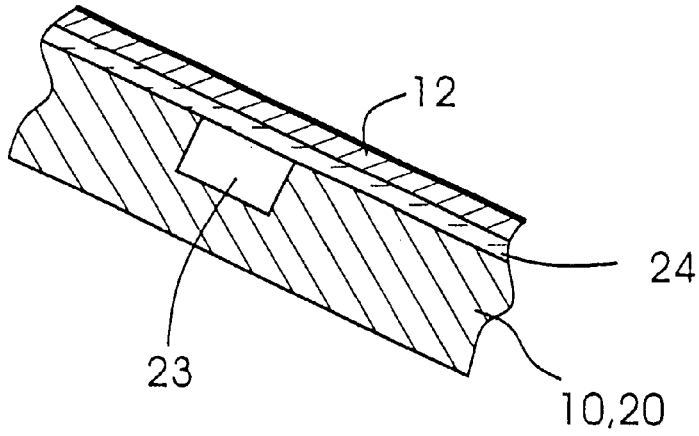

FIG. 6 illustrates an ink fountain foil 12 that is held on the ink fountain base 20 magnetically. For this purpose, a magnet 23 or a number of magnets 23 may be arranged in the ink fountain base 20, and the ink fountain foil 12 may contain a magnetic or ferromagnetic material 24. The material attracted by the magnet 23 may be the basic foil material essentially forming the ink fountain foil 12 or an additional material introduced and admixed, respectively, into the basic foil material at selected locations or uniformly distributed. As shown, the ink fountain foil 12 may be multilayered, and the additional material may also be laminated onto the basic foil material. The magnets 23 may be electromagnets or permanent magnets and the ink fountain foil 12 may contain iron. Through the intermediary of the magnets 23, the ink fountain foil 12 is attracted magnetically from the underside thereof onto the ink fountain bottom 20 and is securely affixed to the ink fountain base 20, just as in the ink fountains described hereinbefore, so that the ink fountain foil 12 cannot lift off the ink fountain base 20.

I claim:

1. An ink fountain for use in a printing machine, the ink fountain comprising:

a base;

an ink fountain foil;

an ink metering device having a plurality of metering elements covered by said ink fountain foil; and a magnetic holding device including a magnet disposed in said base of the ink fountain;

said ink fountain foil having a magnetically attractable material disposed therein rendering said ink fountain foil magnetically attractable; said magnetic holding device attracting and firmly holding an underside of said ink fountain foil directly on said base of the ink fountain.

2. A printing machine having, in combination therewith, at least one ink fountain according to claim 1.

3. The ink fountain according to claim 1, wherein said magnetically attractable material is ferromagnetic.

4. The ink fountain according to claim 1, wherein said ink fountain foil includes a plurality of layers and at least one of said layers includes said magnetically attractable material.

5. An ink fountain for use in a printing machine, the ink fountain comprising:

an ink fountain foil;

an ink metering device having a plurality of metering elements covered by said ink fountain foil; and a suction device disposed on said base of the ink fountain;

said ink fountain foil having an underside, said suction device suctioning and firmly holding said underside of said ink fountain foil directly on said base of the ink fountain.

6. The ink fountain according to claim 5, wherein said suction device has at least one suction orifice disposed in the ink fountain base, said suction orifice being able to be supplied with suction air from a suction-air source.

7. The ink fountain according to claim 6, including an ink fountain roller assigned to the ink fountain for conveying printing ink out of the ink fountain through an ink gap, said at least one suction orifice being disposed in a region of the ink fountain base near said ink gap.

8. The ink fountain according to claim 6, wherein said at least one suction orifice is formed as a groovelike transverse channel extending over substantially the entire width of the ink fountain base and said ink metering device, respectively.

9. The ink fountain according to claim 8, including a plurality of said transverse channels arranged substantially parallel to one another in the ink fountain base.

10. The ink fountain according to claim 6, wherein said metering elements of said ink metering device are adjustable for zonal ink metering, said ink metering device also includes pressure elements for pressing said metering elements against the ink fountain roller, and the ink fountain base is formed at least partially by a suction plate covering said pressure elements and formed with said suction orifice.

11. A method for securely fixing an ink fountain foil on a base of an ink fountain in a printing machine and lining the ink fountain on the inside thereof, which comprises the steps of:

providing an ink fountain foil;

lining the inside of the ink fountain by suctioning the ink fountain foil to the ink fountain base; and prying the ink fountain foil from the ink fountain base to exchange the ink fountain foil.

12. A method for securely fixing an ink fountain foil on a base of an ink fountain in a printing machine and lining the ink fountain on the inside thereof, which comprises:

providing a magnetically attractable ink fountain foil;

providing a magnet in the base of the ink fountain;

lining the inside of the ink fountain by magnetically attracting and holding the magnetically attractable ink fountain foil on the ink fountain base; and prying the ink fountain foil from the ink fountain base to exchange the ink fountain foil.

* * * * *